US005168297A

United States Patent [19]

Wernicke

[11] Patent Number: 5,168,297

[45] Date of Patent: Dec. 1, 1992

[54] COUNTERCURRENT FINAL TREATMENT SYSTEM

[75] Inventor: Ubbo Wernicke, Roesrath-Kleineichen, Fed. Rep. of Germany

[73] Assignee: Agfa Gevaert Aktiengesellschaft, Leverkusen, Fed. Rep. of Germany

[21] Appl. No.: 694,806

[22] Filed: May 2, 1991

Related U.S. Application Data

[63] Continuation-in-part of Ser. No. 565,627, Aug. 10, 1990, abandoned.

[30] Foreign Application Priority Data

Aug. 26, 1989 [DE] Fed. Rep. of Germany ..... 3928331

[51] Int. Cl.[5] ..... G03D 3/02

[52] U.S. Cl. ..... 354/324

[58] Field of Search ..... 354/320-322, 354/324, 338, 339

[56] References Cited

U.S. PATENT DOCUMENTS

| | | | |
|---|---|---|---|
| 3,192,845 | 7/1965 | Schmidt | 354/321 |
| 4,367,941 | 1/1983 | Uenaka et al. | 354/324 |
| 4,451,132 | 5/1984 | Kishimoto | 354/324 |
| 4,641,939 | 2/1987 | Kitner | 354/321 X |
| 4,780,737 | 10/1988 | Kobayashi et al. | 354/322 |
| 4,791,444 | 12/1988 | Fujimoto et al. | 354/324 |
| 5,040,013 | 8/1991 | Kurokawa et al. | 354/322 |

*Primary Examiner*—Michael L. Gellner
*Assistant Examiner*—D. Rutledge
*Attorney, Agent, or Firm*—Connolly & Hutz

[57] ABSTRACT

A countercurrent final treatment system with improve efficiency for photographic material webs consists of at least one final treatment tank with an inlet for the final treatment bath and an outlet for final bath, driven rollers for the transport of the photographic material through the tank on a U-shaped path, final treatment liquid as the photographic material leaves the liquid being enriched with chemicals, a pipe which is open at its upper and lower end and is adapted in width to the photographic material and through which the photographic material is transported said pipe being arranged at that side of the final treatment tank where the photographic material leaves the tank, the lower opening dipping into the final treatment bath and the upper opening being situated above the liquid level of the final treatment bath and said pipe being associated with the inlet of final treatment liquid into the final treatment bath at a point above the liquid level so as to contribute to a flow of liquid through the pipe counter to the transport of the photographic material.

8 Claims, 2 Drawing Sheets

COUNTERCURRENT FINAL TREATMENT SYSTEM

CROSS REFERENCE TO RELATED APPLICATIONS

This application is a continuation-in-part of the copending U.S. application Ser. No. 07/565,627 filed Aug. 10, 1990 now abandoned.

INTRODUCTION

This invention relates to a countercurrent final treatment system for photographic material webs consisting of at least one final treatment tank with an inlet for the final treatment bath and an outlet for the final bath and having driven rollers for the transport of the photographic material through the tank on a U-shaped path, wherein the final treatment liquid, as the photographic material leaves the tank, is enriched with chemicals.

BACKGROUND OF THE INVENTION

Washing units comprising one or more washing tanks through which the photographic material successively passes are known for the treatment of photographic material in a continuous transport system. The fresh water normally required for this purpose is introduced into the last of the washing tanks so that the concentration of treatment chemicals to be dissolved out from the photographic layer is lowest in that tank. The overflow from the last washing tank is then guided into the preceding washing tanks so that the concentration of chemicals increases against the direction of movement of the photographic material. This principle is known as the countercurrent principle both from the standpoint of chemical process engineering and from the standpoint of heat exchangers. The treatment results obtained are better, the greater the number of consecutive treatment steps. However, the expense involved in a treatment system such as this increases with the number of tanks.

A system of the type in question is known, for example, from DE-C-33 20 787, its effect being enhanced by the arrangement of an overflow weir with drainage channel, which extends over the entire width of the tank, on the entry side of, and beneath, the photographic material and by the provision of a first pair of rollers extending over the width of the tank, of which the axial plane is inclined towards the water level, a narrow gap in relation to the length of the tank remaining between the drainage channel and the adjacent roller of the pair of rollers; a water spray pipe parallel to the rollers with outlet openings directed substantially upwards is arranged in the lower part of the tank, extending over the width thereof, in such a way that the jet issuing from the spray pipe is directed onto the gap between the drainage channel and the roller.

This system may also be used in a no-wash processing cycle in which the final wash is replaced by treatment of the material with a stabilizing solution. However, the increase in effectiveness over systems without a spray pipe is not so great that the number of tanks for the stabilizer treatment could be reduced.

In a no-wash processing cycle with stabilizer treatment as the final bath, four tanks for the treatment with stabilizing solution are normally arranged in the form of a countercurrent cascade and are operated with a regeneration quota of 248 ml/m$^2$ and a residence time of 22.5 secs./tank, a carryover rate of approx. 80 ml/m$^2$ having to be taken into account.

At present, it is known that the following measures have to be taken to reduce the number of tanks to only three for the same throughput of material and the same desired dilution effect: increasing the regeneration quota to at least 400 ml/m$^2$, which is counterproductive because it leads to a considerable increase in the accumulation of spent stabilizing bath.

SUMMARY OF THE INVENTION

The problem addressed by the present invention is to provide a final treatment system which manages with a smaller number of tanks for the same effectiveness as before.

This problem is solved by a countercurrent final treatment system as described below having as a feature a pipe in a tank and which is open at its upper and lower end and is adapted in width to the photographic material and through which the photographic material is continuously transported. The pipe is arranged at that side of the final treatment tank where the photographic material leaves the tank, the lower opening dipping into the final treatment bath and the upper opening being situated above the liquid level of the final treatment bath and said pipe being connected to the inlet of the final treatment bath above the liquid level through which fresh final treatment liquid is delivered.

The introduction of the fresh liquid relates to a current of limited quantity of the final treatment liquid which flows through the pipe counter to the advancement of the photographic material through the pipe.

The final treatment bath may be a wash or a stabilizing bath.

Preferably at most 1/5th and, more preferably, 1/10th to 1/100th of the final treatment bath is situated in the pipe. The pipe dips at least so far into the tank as corresponds to 50% of the filling level of the tank. The maximum depth of penetration of the pipe is determined by the extent of the fittings (guide rollers, etc.) in the tank. In order, in these circumstances, to obtain the particular quantity of final bath desired in the tube, it is advisable for the pipe to have an internal diameter of from about 2 to 20 millimeters for standard tank dimensions. The width of the pipe is determined by the width of the photographic material.

In one preferred embodiment of the invention, another pipe of the same type, through which the photographic material is guided, is arranged at that side of the final treatment tank where the photographic material enters the tank, this pipe being directly connected to the outlet by a laterally arranged pipe a few mm below the liquid level.

DESCRIPTION OF THE PREFERRED EMBODIMENTS

In the following description the present invention will be explained in more detail by reference to the drawings.

Figure 1:
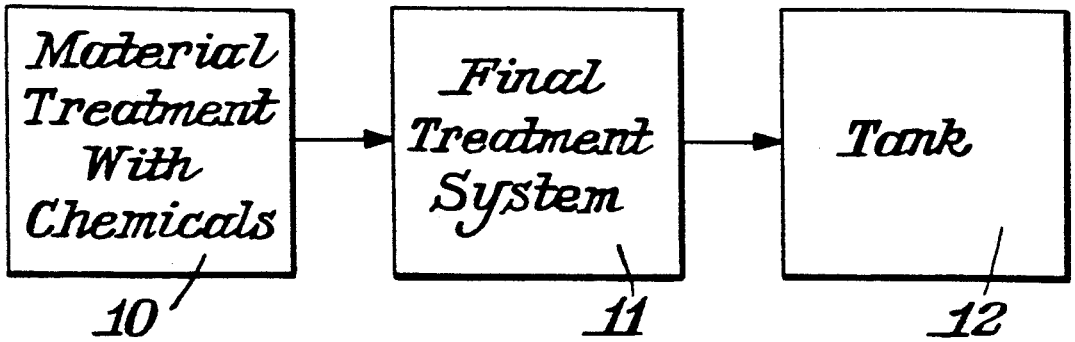
FIG. 1 is a block diagram of elements of the continuous transport system for preparing photographic materials.

FIG. 1 schematically illustrates in a block diagram the arrangement of processing apparatus of the continuous transport system embodying the present invention which comprises apparatus 10 for treatment of photographic material with chemicals, a final treatment system 11, and a tank 12. The processed photographic material passes from the apparatus 10, through the final treatment system 11 and into the tank 12. However, tank 12 which is described for illustrative purposes may be omitted.

Figure 2:
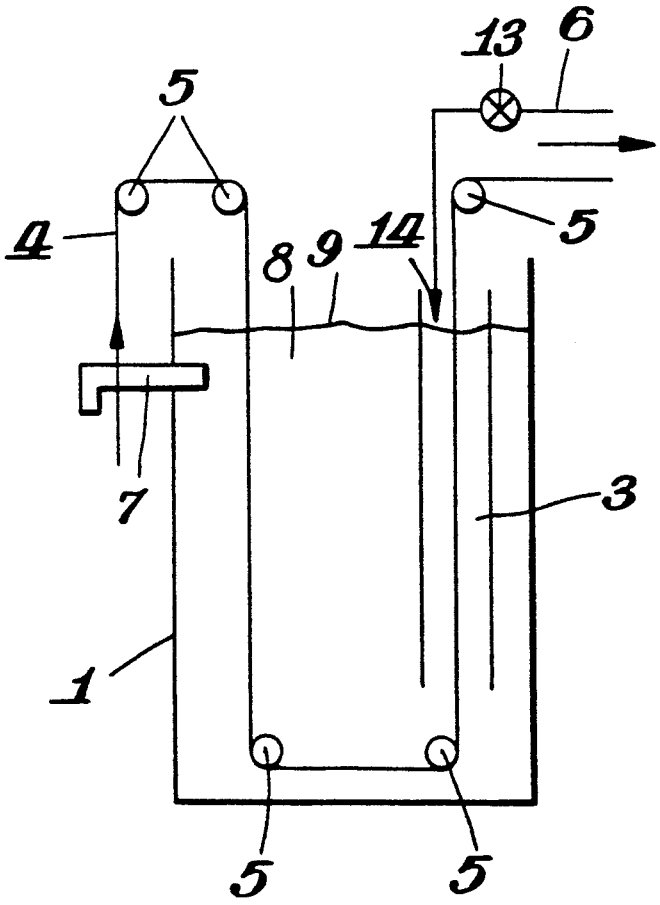
FIG. 2 is a vertical schematic view showing of the final treatment apparatus of the present invention.
Figure 3:
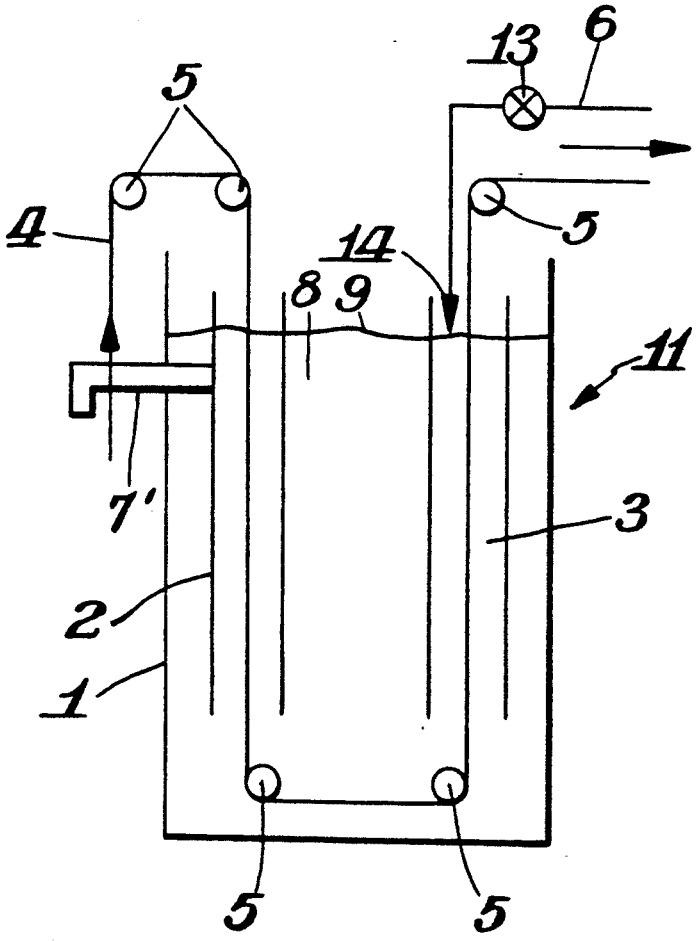
FIG. 3 is a vertical schematic view showing of a modified final treatment apparatus of the present invention.

Embodiments of the final treatment system 11 are illustrated in FIGS. 2 and 3 and the following description. FIG. 2 shows schematically a tank 1 of the final treatment system provided with rollers 5 which guide a continuous photographic material 4 in on an entry side of tank 1 and through a U-path in the tank 1 and out the exit side of the tank 1. The tank 1 contains a first pipe 3 positioned substantially vertically in the tank 1 off-center toward the side of the tank 1 from which the photographic material 4 exits. The pipe 3 is open at each end. The tank 1 as illustrated contains a bath 8 of final treatment liquid forming a bath surface 9. The lower end of pipe 3 extends into the bath 8 preferably to a depth of at least one-half of the depth of bath 8. The upper end of the pipe 3 extends to above surface 9. A delivery pipe 6 having a valve 13 carries fresh final treatment liquid to an inlet 14 into the bath 8. The inlet 14 is associated with the upper end of pipe 3 so that a flow of final treatment liquid through the pipe counter to the advancement of the photographic material 4 through the pipe 3 in its U-shaped path through tank 1 is related to the introduction of fresh final treatment liquid to the bath 8 at the inlet 14.

The photographic material 4 is transported into and out of the tank 1 in a U-shaped path as described above and illustrated in FIG. 2. In its transportation through the right leg of the U-shaped path as seen in FIG. 2 the material 4 moves through the pipe 3 which has an inner diameter adapted to the width of the photomaterial 4. A preferred range of the inner diameter of pipe 3 is 2 to 20 millimeters for standard tank dimensions. A small part of the final treatment liquid of bath 8 is situated in the pipe 3. After being transported through the pipe 3 the continuous photographic material exits from the tank 1 and the final treatment bath 8.

A laterally extending pipe 7 is provided in tank 1 at the entry side of the photographic material 4. The pipe 7 is positioned to extend into the bath 8 below but near the surface 9. Pipe 7 serves as an out-flow of the final treatment liquid from the bath 8.

FIG. 3 is a schematic illustration of a modification of the final treatment system 11 in which an additional pipe 2 is positioned in tank 1 off-center of the tank 1 toward the side at which the continuously transported photographic material enters and is transported through the tank 1 in a U-shaped path the same as in the embodiment of FIG. 2. In its transportation through the left leg of its transportation through the tank 1, the material 4 of FIG. 3 moves through the pipe 2, which has an inner diameter adapted to the width of the photographic material. A pipe 7'positioned in the tank 1 is similar to pipe 7 illustrated in FIG. 2 but is connected into the pipe 2 adjacent its upper end but beneath the surface 9. The pipe 2 similarly to pipe 3 is positioned substantially vertically in the tank 1 and has its lower open end positioned in the bath 8 to a depth of at least half the bath depth and its upper open end above the bath surface 9.

EXAMPLE 1 (COMPARISON)

A commercially available color paper is developed as follows by the conventional process in the following conventional equipment:

| Bath | Time | Regeneration quota |
|---|---|---|
| Developer | 45' | 240 ml/m$^2$ |
| Bleaching/fixing bath | 45' | 160 ml/m$^2$ |
| Stabilizer | 30' | 200 ml/m$^2$ |
| Stabilizer | 30' | 200 ml/m$^2$ |
| Stabilizer | 30' | 200 ml/m$^2$ |

The volume of the stabilizer tank is approximately 6 liters. The tanks are not cascaded.

The key constituents of the bleaching/finishing bath used are

| | |
|---|---|
| ammonium thiosulfate | 100 g/l |
| iron ammonium EDTA | 50 g/l |
| sodium sulfite | 20 g/l. |

During the processing of approx 100 m$^2$ color paper, the concentration of the bleaching/fixing bath is kept constant by addition of a suitable regenerator.

The concentration of ammonium thiosulfate and iron ammonium EDTA in a first tank after the bleaching-/fixing bath is then analytically determined:

| | |
|---|---|
| ammonium thiosulfate | 19 g/l |
| iron ammonium EDTA | 9.1 g/l |

The concentrations in a second tank after the bleaching/fixing bath is also determined:

| | |
|---|---|
| ammonium thiosulfate | 4.6 g/l |
| iron ammonium EDTA | 1.9 g/l |

EXAMPLE 2 (INVENTION)

The photographic material processing system of the present invention was provided having a bleaching/fixing bath in apparatus 10 and pipe 3 as illustrated in FIG. 2 was installed on the exit side of the tank 1 as a first tank after the bleaching/fixing bath with its upper end above the liquid level, lower end constricted by stripper lips; length 20 cm, internal diameter 15 mm.

The color paper was passed through this pipe, in which about 5% of the bath volume was situated, before leaving the tank 1, the first after the bleaching/fixing bath and then entered the tank 12, the second tank after the bleaching/fixing bath.

The regenerator liquid was semi-continuously introduced into the upper opening of the pipe 3 at a rate of 200 ml/m$^2$ by means of a reciprocating pump.

After the processing of 100 m$^2$ color paper, the concentrations in the tank 12 after the bleaching/fixing bath are

| | |
|---|---|
| ammonium thiosulfate | 1.0 g |
| iron ammonium EDTA | 0.4 g |

The equilibrium concentrations established in the second tanks after the bleaching/fixing bath are in a ratio of 1:0.2, i.e. the system according to the invention is 5 times more effective than the conventional process.

I claim:

1. In a continuous transport system for the preparation of photographic materials involving treatment with chemicals, the combination with at least one treatment means of a countercurrent final treatment system comprising a container for a treatment liquid, means for receiving and advancing a continuous photographic material in a U-shaped path through said container into an entry side of the container and from an exit side of the container, a first pipe having openings at each end positioned within said container more adjacent to the exit side of the container and disposed so that an upper end opening of the pipe is situatable above the surface of a liquid in the container and a lower end opening is situatable within a liquid contained in the container and arranged to receive the advanced photographic material so that the material in one leg of the U-shaped path passes through the pipe, said first pipe being adapted to contain the liquid as the material is advanced therethrough an inlet in said final treatment system for delivering liquid into the container at the first pipe so that the delivery of liquid is associated with a flow of liquid through said first pipe, and an outlet in said container for removal of overflow of said liquid, whereby a flow of contained liquid may be provided counter to the direction of advancement of the material through the container.

2. The combination in a system as claimed in claim 1 of a final treatment bath of said liquid wherein at most 1/5th of the bath is situated in the first pipe.

3. The combination as claimed in claim wherein from 1/10th to 1/100th of the bath is situated in the first pipe.

4. The system as claimed in claim 1, having a second pipe having openings at each end through which the photographic material is guided, positioned on the entry side of the container, this second pipe being directly connected to the outlet by a laterally arranged pipe a few millimeters below the liquid level.

5. A countercurrent final treatment system comprising a container for a treatment liquid, means for receiving and advancing a continuous photographic material in a U-shaped path through said container into an entry side of the container and from an exit side of the container, a first pipe having openings at each end positioned within said container more adjacent to the exit side of the container and disposed so that an upper end opening of the pipe is situatable above the surface of a liquid in the container and a lower end opening is situatable within a liquid contained in the container and arranged to receive the advanced photographic material so that the material in one leg of the U-shaped path passes through the pipe, said first pipe being adapted to contain the liquid as the material is advanced therethrough an inlet in said final treatment system for introducing liquid into the container at the first pipe so that the delivery of liquid is associated with a flow of liquid through said first pipe, an outlet in said container for removal of overflow of said liquid, whereby a flow of contained liquid may be provided counter to the direction of advancement of the material through the container.

6. The combination in a system as claimed in claim 5 of a final treatment bath of said liquid wherein at most 1/5th of the bath is situated in the first pipe.

7. The combination as claimed in claim 6 wherein from 1/10th to 1/100th of the bath is situated in the first pipe.

8. The system as claimed in claim 5, having a second pipe having openings at each end, through which the photographic material is guided, positioned on the entry side of the container, this second pipe being directly connected to the outlet by laterally arranged pipe a few millimeters below the liquid level.

* * * * *